US006938765B2

(12) United States Patent
Awad

(10) Patent No.: US 6,938,765 B2
(45) Date of Patent: Sep. 6, 2005

(54) RAZOR BLADE HOLDER

(76) Inventor: Hassan Awad, 457 Mercer St., Jersey City, NJ (US) 07302-3119

( * ) Notice: Subject to any disclaimer, the term of this patent is extended or adjusted under 35 U.S.C. 154(b) by 39 days.

(21) Appl. No.: 10/080,904

(22) Filed: Feb. 25, 2002

(65) Prior Publication Data

US 2003/0159957 A1 Aug. 28, 2003

(51) Int. Cl.[7] ..... B65D 85/62

(52) U.S. Cl. ..... 206/354; 206/353; 206/459.5; 211/50; 220/476; 220/482

(58) Field of Search ..... 220/476, 482; 229/115; 248/205.3; 206/352–360, 459.5, 461, 466; 211/50; 383/9, 12, 13, 22, 25

(56) References Cited

U.S. PATENT DOCUMENTS 1,019,275 A * 3/1912 Press ..... 211/50
1,614,265 A * 1/1927 Stockton ..... 131/240.1
3,207,320 A * 9/1965 Nichols ..... 211/50
3,751,172 A * 8/1973 Seitz et al. ..... 356/244
4,307,809 A * 12/1981 Haswell ..... 211/40
4,444,314 A * 4/1984 Jacobsson ..... 206/425
4,632,256 A * 12/1986 Gambello ..... 211/50
5,683,019 A * 11/1997 Schaber ..... 224/191
5,697,549 A * 12/1997 Yocum ..... 229/400
6,092,673 A * 7/2000 Woolnough et al. ..... 211/50

* cited by examiner

*Primary Examiner*—Jim Foster
(74) *Attorney, Agent, or Firm*—Thomas L. Adams

(57) ABSTRACT

A razor blade holder can attach to structure at a site in order to provide blade storage and accessibility. The holder has a receptacle sized to hold at least one razor blade and to keep exposed and accessible an upper edge thereof. The receptacle has a back panel adapted to be attached to the structure.

7 Claims, 1 Drawing Sheet

FIG. 1
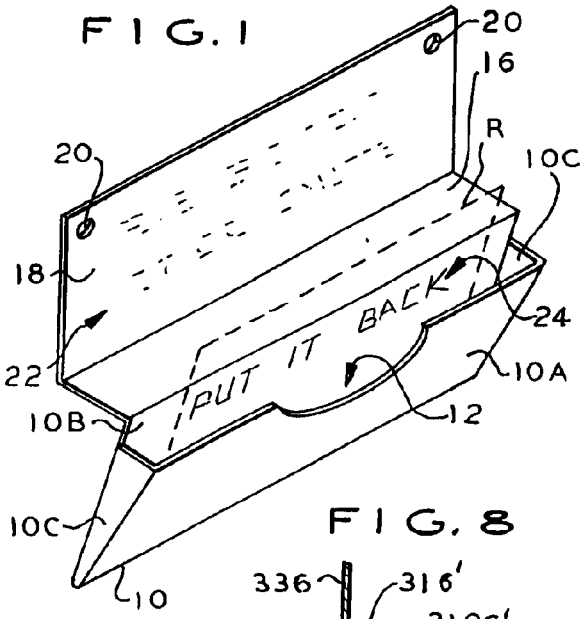
FIG. 2
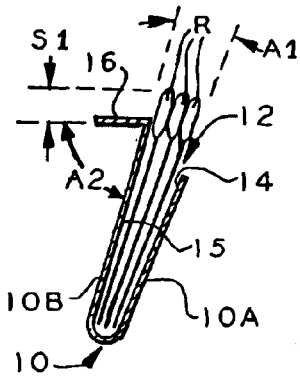
FIG. 8
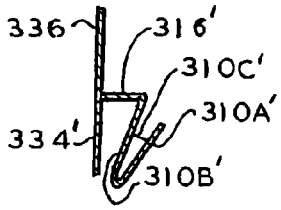
FIG. 4C
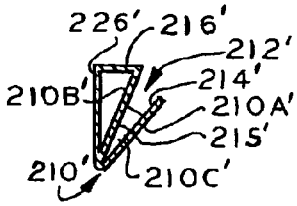
FIG. 3
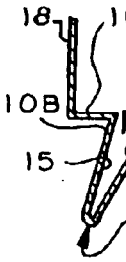
FIG. 4A
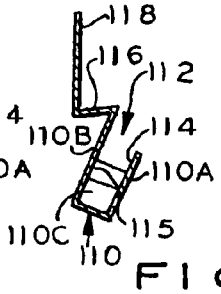
FIG. 4B
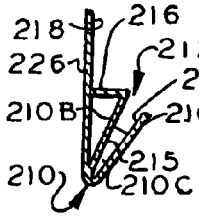
FIG. 5
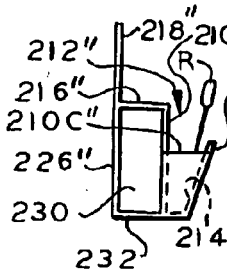
FIG. 6
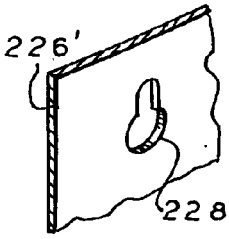
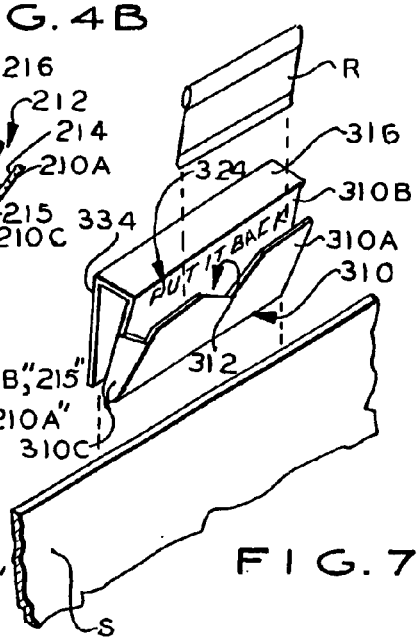
FIG. 7

RAZOR BLADE HOLDER

BACKGROUND OF THE INVENTION

1. Field of the Invention

The present invention relates to razor blade holders, and in particular to holders providing blade storage and accessibility.

2. Description of Related Art

In many work environments it is useful to have a razor blade handy for periodic cutting projects. In some cases a razor blade may be mounted in a larger handle, which allows one to use one's entire hand to manipulate the razor's edge. A disadvantage with such cutting tools is its relative bulk. Also, the user will need a storage box or a relatively large holder to keep the cutter handy. Moreover, a large cutting tool may be inappropriate for small jobs performed in tight spaces, or situations where detail cutting must be performed with a blade held in the user's fingertips.

In U.S. Pat. No. 5,555,624 a relatively small case can hold a razor blade for cutting open jewel boxes for CDs. This holder requires that the razor blade have notches on opposite edges to hold the blade in place. Furthermore, the holder restricts the use of the blade. For example, this holder would make impossible routine functions, such as scraping paint from a surface with the blade held at a relatively low angle of attack. This reference suggests securing the holder to a surface with a hook and loop fastener. This method of securing does not enhance safety by guarding the edge of the blade. Instead, this reference relies on fixed guard panels on the case that always surround the edge of the blade whether stored or in use.

In U.S. Pat. No. 5,148,916 a razor blade is stored between two magnetic strips that are hinged to fold together and enclose the blade. This reference shows a key chain for holding the magnetic strips. The razor blade is not easily fetched from this holder, since the user must pry apart the magnetic strips.

Accordingly, there is need for an improved razor blade holder that allows one to quickly and easily seize a razor blade that can then be used in a variety of work environments.

SUMMARY OF THE INVENTION

In accordance with the illustrative embodiments demonstrating features and advantages of the present invention, there is provided a razor blade holder adapted to attach to structure at a site in order to provide blade storage and accessibility. The holder has a receptacle sized to hold at least one razor blade and to keep exposed and accessible an upper edge thereof. The receptacle has a back panel adapted to be attached to the structure.

By employing apparatus of the foregoing type, an improved razor blade holder is achieved. In the preferred embodiment a razor blade can be stored in a molded plastic pocket or receptacle that is suspended from a horizontal branch of an L-shaped bracket. The horizontal branch acts as a shelf to provide clearance behind the upper exposed edge of the blade, making it easy to grasp and retract. Preferably, the pocket is tilted so the upper end of the blade is outwardly inclined, further increasing its accessibility. Also, the preferred pocket is tapered to converge slightly towards its bottom. This allows a number of blades to be placed inside the pocket so that the tips of the blades can be wedged into place.

In the preferred embodiment a vertical branch of the L-shaped bracket can be secured to a surface existing at a work site. In some embodiments the vertical branch is a panel that is a adhesively backed to secure the holder to an existing surface at the work site. In some embodiments this vertical panel may have fastening holes allowing the holder to be secured in place by screws, nails, or the like. Other clip-like fastening means are disclosed as well.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 1 is an axonometric view of a razor blade holder in accordance with principles of the present invention;

FIG. 2 is a detailed, cross-sectional view of a portion of a fragment of the holder of FIG. 1, showing a plurality of razor blades stored therein;

FIG. 3 is a cross-sectional view of the holder of FIG. 1;

FIGS. 4A, 4B, and 4C are cross-sectional views of a holder that is an alternate to that of FIG. 3;

FIG. 5 is an end view of a holder it that is an alternate to that of FIG. 1 ;

FIG. 6 is a detailed, axonometric view of a fragment of the back panel of FIG. 1, but modified to show an alternate fastening hole;

FIG. 7 is an exploded, axonometric view of a holder that is an alternate to that of FIG. 1, showing the holder adjacent to supporting structure, as well as a razor blade that can be stored in the holder;

FIG. 8 is a cross-sectional view of a holder and that is an alternate to that of FIG. 7.

DETAILED DESCRIPTION OF THE PREFERRED EMBODIMENTS

Referring to FIGS. 1, 2 and 3, a razor blade holder is shown with a receptacle 10 having a forward wall 10A, a rear wall 10B, and two side walls 10C. Receptacle 10 has an opening 12 leading to a region flanked by a forward face 14 and an opposite rear face 15. Receptacle 10 is designed to receive a razor blade R, shown in FIG. 1 in phantom.

The upper edge of wall 10B is integrally connected to shelf 16 shown here in as a horizontal branch of an L-shaped member including a vertical branch herein referred to as back panel 18. Back panel 18 can be mounted to the surface of a structure at a work site. In some embodiments the rear face of back panel 18 can have an adhesive backing to adhesively secure the holder to a surface. In this embodiment, back panel 18 is also shown with fastening holes 20 that may be used to secure the holder with screws, nails, or other fastening means.

The front face of back panel 18 is shown marked with a commercial message 22. In some embodiments the illustrative holder can be marked with an advertisement that subsidizes the manufacturing cost, so that the holder can be sold for a nominal price or can be distributed without charge. Alternatively, the holder may be bundled with a package of razor blades, in which case back panel 18 can be marked with the trademark of the manufacturer of the razor blades.

Also, a reminder message 24 is marked on rear wall 10B. In this case the user is reminded to replace the razor blade after use ("PUT IT BACK"). Other reminders or commercial messages are contemplated.

The illustrated holder can be injection molded or can be made by folding stiff paper, sheet plastic, or cardboard, keeping the receptacle together by gluing, taping, etc. In still other embodiments, the holder can be formed as a plastic extrusion with the side walls 10C being installed later. Alternatively, the holder can be formed of a number of separate components that are snapped together, or attached together by gluing, or other fastening means. In addition, the holder can be formed from a metal stamping that forms the illustrated three-dimensional structure, or by stamping a flat development that is then later folded to form the illustrated structure.

Referring to FIG. 2, faces 14 and 16 are shown downwardly converging at an acute angle A1. Angle A1 may be in a range of 0° to 30°, and is preferably 10°. This angle is chosen to accommodate the number of razor blades one wishes to hold, and to establish a desired wedging action. As shown in this Figure, the chosen angle can accommodate three razor blades R. Blades R are shown as single edge razor blades having handles on the edge opposite the cutting-edge.

The lower cutting-edges of the blades R will snugly fit at the bottom of opening 12. For a larger number of blades the angle A1 may be increased and the bottom of opening 12 can be expanded. Alternatively, the angle A1 can be decreased and the bottom of opening 12 constricted to accommodate a lesser number, for example, one blade.

Also, the opening 12 has a limited depth which allows blades R to extend outside the opening and enhance their accessibility. Moreover, shelf 16 spaces the handles of blades R away from back panel 18. Therefore, the handles of blades R are accessible from above, from behind, and from the front. In addition, the receptacle 10 is tilted so that the handles of blades R extend upward and outward. This further enhances the accessibility of blades R. This tilt establishes an angle A2 between the rear wall 10B and shelf 16. Angle A2 may be in the range of 90° to 60°, and is preferably 80°.

For the alternate holder of FIG. 4A, components corresponding to those previously illustrated are marked with the same reference numerals, but increased by 100. Accordingly, an L-shaped bracket includes a vertical back panel 118 integrally connected to a horizontal shelf 116. A receptacle 110 is suspended at an angle from shelf 116 and has a pair of side walls 110C. Receptacle 110 also has a front wall 110A and a real rear wall 110B defining an opening 112 embraced by a forward face 114 and a parallel rear face 115.

The holder of FIG. 4A is substantially the same as that of FIG. 1 except that walls 110A and 110B are parallel. This provides an opening 112 where razor blades can be loosely deposited and without necessarily becoming wedged together at the bottom of the opening 112.

For the alternate holder of FIG. 4B, components corresponding to those previously illustrated in FIG. 1 are marked with the same reference numerals, but increased by 200. Accordingly, an L-shaped bracket includes a vertical back panel 218 integrally connected to a horizontal shelf 216. A receptacle 210 is suspended at an angle from shelf 216 and has a pair of side walls 210C. Receptacle 210 also has a front wall 210A and a real rear wall 210B defining an opening 212 embraced by a forward face 214 and an overhanging face 215.

In this embodiment, the back panel 218 is extended to provide a back wall 226 connecting between the rear edge of shelf 216 and the bottom of rear wall 210B to form a hollow body composed of elements 226, 216, 210B. Elements 218 and 226 are contiguous and co-planar. In some embodiments the holder of FIG. 4B can be formed of an extrusion and capped at either end with side walls 210C. Moreover, the hollow body composed of elements 226, 216, 210B can also be capped at either end to form a closed volume, if desired.

For the alternate holder of FIG. 4C, components corresponding to those previously illustrated in FIG. 4B are marked with the same reference numerals, but annotated with a prime (′). Essentially, this holder is identical to that of FIG. 4B, except that the previously mentioned upper portion of the back panel (panel 218) is eliminated. Under the circumstances, element 226′ serves as a back panel and may have an adhesive backing to secure the holder in place. Alternatively, panel 226′ may have several key hole-shaped fastening openings such as opening 228, shown in FIG. 6.

For the alternate holder of FIG. 5, components corresponding to those previously illustrated in FIG. 4B are marked with the same reference numerals, but annotated with a double prime (″). A rectangular back panel is formed of an upper portion 218″ and a lower portion 226″. As before, back panel 218″, 226″ can have an adhesive backing. A hollow body enclosing a parallelepiped cavity 230 is formed of a horizontal shelf 216″, a rear wall 210B″ and a bottom wall 232. Cavity 230 is designed to accept spare razor blades that can be stored in the cavity either loosely or in a separate container.

A diverging front wall 210A″ forms an opening 212″ for holding razor blades between front face 214″ and rear face 215″. As before, the opening 212″ can be closed on either end with side walls 210C″.

For the alternate holder of FIG. 7, components corresponding to those previously illustrated in FIG. 1 are marked with the same reference numerals, but increased by 300. In particular, a receptacle 310 is formed with a front wall 310A, rear wall 310B, and side walls 310C. The opening 312 is tilted so that when seated, razor blade R will tilt upwardly and outwardly for easy access. A horizontal shelf 316 is connected along the upper edge of wall 310B. Depending from the rear edge of shelf 316 is a back panel 334 that converges on but does not touch rear wall 310B.

With this arrangement, back panel 334 can act as a clip so that the holder can be secured over the edge of structure S. Specifically, back panel 334 and back wall 310B will straddle structure S. Alternatively, back panel 334 can have an adhesive backing, in which case the holder can be glued to the face of structure S. In still other embodiments, the back panel 334 can have a keyhole-shaped fastening hole as shown in FIG. 6 (hole 228) enabling the holder to be secured to a nail or screw head in structure S. It will be appreciated that the holder of FIG. 7 can therefore be mounted in a variety of ways either by means of clipping, gluing or other fastening means, such as screws and nails.

For the alternate holder of FIG. 8, components corresponding to those previously illustrated in FIG. 7 are marked with the same reference numerals, but annotated with a prime (′) Essentially, this holder is identical to that of FIG. 7, except that the previously mentioned back panel (panel 334) is upwardly extended to form an enlarged back panel 336, 334′. The upper portion 336 of the back panel can serve as a site for advertising messages in a manner similar to that shown in FIG. 1. Moreover, elements 336 and 334′ may both have an adhesive backing to secure the holder in place.

To facilitate an understanding of the principles associated with the foregoing apparatus, its operation will be briefly described in connection with the embodiment of FIG. 1; although the operation for the other embodiments will be similar. The back panel 18 can be secured to a wall, shelf edge, toolbox or other structure. In some embodiments adhesive backing on panel 18 will secure the holder. In other instances the holder can be secured by driving in nail, screw, or other fastener through holes 20. Once in place, one or more razor blades R can be placed in the opening 12.

As shown in FIG. 2, the razor blades R tilt forwardly for easy access. Also, the blades R rise above shelf 16 so that the upper handle edge of the blades R are accessible from the front, top and back. The user may now grasp the razor blades to R by placing a thumb on the front blade and a forefinger over the top, resting on the shelf 16. The thumb can then be lifted to pull out the first blade R, using a motion as if dealing cards.

If all of the razor blades R were removed the message 24, "PUT IT BACK," becomes prominent. The user is then regularly reminded of the need to replace the razor blade. It will also be appreciated that the illustrated holder sheathes the cutting edge of the blades R and prevents injury. Furthermore, the blades R are free from any encumbrances and can therefore be used in tight spaces.

Obviously, many modifications and variations of the present invention are possible in light of the above teachings. It is therefore to be understood that within the scope of the appended claims, the invention may be practiced otherwise than as specifically described.

What is claimed is:

1. A razor blade holder adapted to attach to structure at a site in order to provide blade storage and accessibility, comprising:

a receptacle sized to hold at least one razor blade and to keep exposed and accessible an upper edge thereof, said receptacle having a downwardly converging opening with a forward face and a higher rear face for receiving the razor blade, said receptacle being tilted to allow the razor blade to freely project outwardly, the rear face of the opening being marked with a reminder message; and a shelf extending back from the opening of said receptacle to establish clearance for finger access behind the opening of said receptacle, said receptacle including:

an adhesively backed back panel connected to said shelf and adapted to be attached to said structure, said back panel extending to a higher elevation than said opening, said back panel being marked in front with a commercial message.

2. A razor blade holder according to claim 1 wherein the at least one razor blade comprises a plurality of razor blades each having a cutting edge, the opening of said receptacle having a bottom shaped and sized to closely and adjacently fit the cutting edge of the plurality of razor blades.

3. A razor blade holder according to claim 1 wherein said back panel has at least one fastening hole.

4. A razor blade holder according to claim 1 wherein said receptacle comprises:

a hollow body; and a front wall connected to said hollow body, said front wall upwardly and outwardly extending in front of said hollow body.

5. A razor blade holder according to claim 4 wherein said hollow body has an overhanging face slanted to overhang said front wall.

6. A razor blade holder according to claim 4 wherein said hollow body has a parallelepiped cavity.

7. A razor blade holder according to claim 6 wherein said parallelepiped cavity is open and sized to hold spare razor blades.

* * * * *